US010302258B2

(12) United States Patent
Blair et al.

(10) Patent No.: US 10,302,258 B2
(45) **Date of Patent: *May 28, 2019**

(54) DEPLOYABLE, MULTI-SIDED ILLUMINATION DEVICES AND RELATED METHODS OF USE

(71) Applicant: Night Angel Products, LLC, Elbridge, NY (US)

(72) Inventors: Kevin J. Blair, Fulton, NY (US); Kevin D. Sullivan, Auburn, NY (US); Richard A. Roberts, Auburn, NY (US); Michael M. Muehlemann, Liverpool, NY (US)

(73) Assignee: Night Angel Products, LLC, Elbridge, NY (US)

( * ) Notice: Subject to any disclaimer, the term of this patent is extended or adjusted under 35 U.S.C. 154(b) by 72 days.

This patent is subject to a terminal disclaimer.

(21) Appl. No.: 15/419,630

(22) Filed: Jan. 30, 2017

(65) Prior Publication Data

US 2017/0205035 A1 Jul. 20, 2017

Related U.S. Application Data

(63) Continuation of application No. 14/918,081, filed on Oct. 20, 2015, now Pat. No. 9,557,038.

(Continued)

(51) Int. Cl.

*F21L 4/02* (2006.01)
*F21L 4/08* (2006.01)

(Continued)

(52) U.S. Cl.

CPC ..... *F21L 4/02* (2013.01); *F21L 4/08* (2013.01); *F21S 6/004* (2013.01); *F21S 9/02* (2013.01);

(Continued)

(58) Field of Classification Search

None

See application file for complete search history.

(56) References Cited

U.S. PATENT DOCUMENTS 1,728,547 A 9/1929 Herweg
3,610,916 A 10/1971 Meehan (Continued)

FOREIGN PATENT DOCUMENTS

WO WO2012041432 A1 4/2012
WO WO2014066917 A1 5/2014
WO WO2015112269 A2 7/2015

OTHER PUBLICATIONS

La Police Gear, "Brite Strike Set of 3 Tactical Balls", archived on Sep. 27, 2015, accessed Oct. 28, 2015, Archive.org, URL: <http://web.archive.org/web/20150927093945/http://www.lapolicegear.com/brite-tactical-balls.html> (3 pages).

(Continued)

*Primary Examiner* — Anh T Mai
*Assistant Examiner* — Zachary J Snyder
(74) *Attorney, Agent, or Firm* — Bookoff McAndrews, PLLC

(57) ABSTRACT

An illumination device may include a body having twelve sides, the body being formed by a first body portion including six sides of the twelve sides, and a second body portion including six sides of the twelve sides. The first body portion and the second body portion may be coupled to one another at a first interface and at a second interface disposed radially inward of the first interface, wherein the first interface may be positioned in a plurality of planes, and wherein the second interface may be positioned in a single plane. At least a portion of each of the twelve sides may include a transparent window. The illumination device may include a resilient cover disposed around the body.

18 Claims, 4 Drawing Sheets

Related U.S. Application Data

(60) Provisional application No. 62/122,460, filed on Oct. 21, 2014.

(51) Int. Cl.

| | |
|---|---|
| ***F21S 6/00*** | (2006.01) |
| ***F21S 9/02*** | (2006.01) |
| ***F21V 3/00*** | (2015.01) |
| ***F21V 15/01*** | (2006.01) |
| ***F21V 15/04*** | (2006.01) |
| ***F21V 23/04*** | (2006.01) |
| ***F21V 23/06*** | (2006.01) |
| ***F42B 12/42*** | (2006.01) |
| ***F21W 131/40*** | (2006.01) |
| ***F21Y 101/00*** | (2016.01) |
| ***F21Y 105/14*** | (2016.01) |
| ***F21Y 107/40*** | (2016.01) |
| ***F21Y 115/10*** | (2016.01) |
| ***F21S 8/08*** | (2006.01) |
| ***F21V 19/04*** | (2006.01) |
| ***F21V 23/00*** | (2015.01) |
| ***F21V 21/116*** | (2006.01) |

(52) U.S. Cl.

CPC ..... *F21V 3/00* (2013.01); *F21V 15/01* (2013.01); *F21V 15/04* (2013.01); *F21V 23/005* (2013.01); *F21V 23/04* (2013.01); *F21V 23/0414* (2013.01); *F21V 23/06* (2013.01); *F42B 12/42* (2013.01); *F21W 2131/40* (2013.01); *F21Y 2101/00* (2013.01); *F21Y 2105/14* (2016.08); *F21Y 2107/40* (2016.08); *F21Y 2115/10* (2016.08)

(56) References Cited

U.S. PATENT DOCUMENTS

| | | | |
|---|---|---|---|
| 5,222,798 | A | 6/1993 | Adams |
| 5,670,942 | A | 9/1997 | Lewis |
| 7,088,222 | B1 | 8/2006 | Dueker et al. |
| 7,163,313 | B2 | 1/2007 | Rosenberg |
| 7,614,959 | B1 | 11/2009 | Gentile |
| 8,312,814 | B2 | 11/2012 | Davis et al. |
| 8,519,369 | B1 | 8/2013 | Benjamin et al. |
| 8,727,918 | B1 | 5/2014 | Gentile |
| 8,727,919 | B1 | 5/2014 | Gentile |
| 2005/0094395 | A1 | 5/2005 | Rosenberg |
| 2005/0231961 | A1 | 10/2005 | Mahoney |
| 2008/0216699 | A1 | 9/2008 | McAleer et al. |
| 2008/0239708 | A1 | 10/2008 | Bushee |
| 2009/0156092 | A1 | 6/2009 | Zawitz |
| 2009/0251889 | A1 | 10/2009 | Bushee |
| 2010/0072895 | A1 | 3/2010 | Glynn et al. |
| 2010/0285909 | A1 | 11/2010 | Voelker et al. |
| 2012/0287611 | A1 | 11/2012 | Wilson et al. |
| 2013/0176401 | A1 | 7/2013 | Monari et al. |
| 2013/0215624 | A1 | 8/2013 | Brinzey |
| 2014/0042467 | A1 | 2/2014 | Livesay et al. |
| 2014/0126187 | A1 | 5/2014 | Bennett et al. |
| 2014/0268700 | A1 | 9/2014 | Mumma |
| 2015/0159846 | A1 | 6/2015 | Hollinger |

OTHER PUBLICATIONS

International Search Report and Written Opinion dated Jan. 14, 2016 in corresponding International PCT Application No. PCT/US15/56428, filed on Oct. 20, 2015 (9 pages).

DEPLOYABLE, MULTI-SIDED ILLUMINATION DEVICES AND RELATED METHODS OF USE

CROSS-REFERENCE TO RELATED APPLICATION(S)

This patent application is a continuation application of U.S. patent application Ser. No. 14/918,081, filed on Oct. 20, 2015, now U.S. Pat. No. 9,557,038, which claims the benefit of priority to U.S. Provisional Patent Application No. 62/122,460, filed on Oct. 21, 2014, the entireties of each of which are hereby incorporated herein by reference.

TECHNICAL FIELD

Various examples of the present disclosure relate generally to illumination devices and related methods of use. More specifically, the present disclosure relates to illumination devices having a delayed activation mechanism.

BACKGROUND

Typically, police, tactical, and/or military forces use flashlights and/or spotlights for illuminating dark areas anticipated to have hostile subjects. Flashlights are typically designed to be physically held by or attached to the user, e.g., by hand, hat, belt, clothing, glove, shield, gun, etc. This physical attachment of the flashlight to the user can render the user as a target attracting weapon fire and the attention of hostile subjects. Similarly, police and military forces use vehicle-mounted spotlights to illuminate dark areas, such as alleys and lots. Again, the physical attachment of a spotlight to a vehicle renders the spotlight relatively immobile, restraining several degrees of freedom of the light, and tethering the user to the vehicle and spotlight.

Moreover, user- and vehicle-mounted lights often prevent police and military forces from being able to illuminate areas before entering them. For instance, if a police officer is entering a dark home, or if a military unit is turning a dark corner, the dark home or corner will not be illuminated until the forces have entered the dark area, thereby subjecting the forces to potential danger or surprise. Furthermore, existing flashlights and spotlights are typically either on or off, which reduces the ability of military and law enforcement officers to customize and tailor the timing of turning on and off their tactical lighting devices.

Thus, a need exists for providing police, tactical, and/or military forces with light sources that overcome the drawbacks of existing systems.

SUMMARY OF THE DISCLOSURE

In one aspect, the present disclosure is directed to an illumination device. The illumination device may include a body having twelve sides, the body being formed by a first body portion including six sides of the twelve sides, and a second body portion including six sides of the twelve sides. The first body portion and the second body portion may be coupled to one another at a first interface and at a second interface disposed radially inward of the first interface, wherein the first interface may be positioned in a plurality of planes, and wherein the second interface may be positioned in a single plane. At least a portion of each of the twelve sides may include a transparent window. The illumination device may include a resilient cover disposed around the body. The resilient cover may have twelve sides, wherein each of the twelve sides of the resilient cover may extend over a respective side of the body. Each of the twelve sides of the resilient cover may include an opening positioned over one of the transparent windows of the body. The illumination device also may include a plurality of illumination sources. Each of the plurality of illumination sources may be positioned on an interior side of a transparent window of the body. The illumination device may include a power source configured to deliver power to each of the plurality of illumination sources, and a controller coupled to the power source and to the plurality of illumination sources. The illumination device may include a charging port disposed in one of the twelve sides of the body. The charging port may be operatively coupled to both the power source and the controller. The illumination device may include an activation element that is insertable into the charging port. The controller may be configured to maintain the plurality of illumination sources in an off state when the activation element is positioned inside of the charging port, and sense a removal of the activation element from the charging port. The controller also may be configured to maintain the plurality of illumination sources in the off state for a delay of at least two seconds after the removal of the activation element from the charging port, and activate plurality of illumination sources after the delay.

The illumination device may include a vibration unit. The controller may be further configured to cause the vibration unit to vibrate after sensing removal of the activation element from the charging port. The illumination device may include a potting material disposed within an internal volume of the body.

In another aspect, the present disclosure is directed to an illumination device. The illumination device one or more illumination sources, and a controller coupled the one or more illumination sources. The illumination device may also include an activation mechanism. The controller may be configured to maintain the one or more illumination sources in an off state when the activation mechanism is in a first state, and sense a conversion of the activation mechanism from the first state to a second state. The controller may also be configured to maintain the one or more illumination sources in the off state for a delayed period of time after the transition of the activation mechanism from the first state to the second state, and activate the one or more illumination sources after the delayed period of time.

The activation mechanism may include a port and an activation element insertable into the port. The activation mechanism may be in the first state when the activation element is disposed within the port, and the activation mechanism may be in the second state when the activation element is removed from the port. The illumination device may include a power source configured to deliver power to each of the one or more illumination sources, and the port may also configured to be coupled with a charging device to charge the power source. The delayed period of time may be at least five seconds. The illumination device may include a vibration unit, and the controller may be further configured to cause the vibration unit to vibrate after sensing conversion of the activation mechanism from the first state to a second state. The illumination device may include a body having one or more sides, and the one or more illumination sources may be coupled to an interior surface of the one or more sides. The illumination device may include a potting material disposed within an internal volume of the body. The body may have twelve sides. The body may have twelve illumination sources, and at least one illumination source may be coupled to an interior surface of each of the twelve sides. The body may be formed by joining two body portions to one another. Each body portion may include six of the twelve sides of the body. The two body portions may be coupled to one another at a first mating interface and at a second mating interface, the first mating interface may be disposed in a single plane, and the second mating interface extending through multiple planes. The first mating interface may be disposed radially inward of the second mating interface. The illumination device may include a resilient cover disposed around the body, the resilient cover may have one or more sides, and each of the sides of the resilient cover may extend over a respective side of the body, and each of the sides of the resilient cover may include an opening positioned over one of the respective side of the body.

In yet another aspect, the present disclosure is directed to an illumination device. The illumination device may include a body having six or more sides, and each side of the body may have a transparent window. The illumination device may include a resilient cover disposed around the body, the resilient cover may have the same number of sides as the body, each of the sides of the resilient cover may extend over a respective side of the body, and each of the sides of the resilient cover may include an opening positioned over a transparent window of the body. The illumination device may include one or more illumination devices disposed within the body and configured to emit light through a respective transparent window of the body and opening of the resilient cover.

The body and the resilient cover may each have twelve sides.

BRIEF DESCRIPTION OF THE FIGURES

The accompanying drawings, which are incorporated in and constitute a part of this specification, illustrate various examples and together with the description, serve to explain the principles of the disclosed examples.

DETAILED DESCRIPTION

Reference will now be made in detail to examples of the present disclosure, examples of which are illustrated in the accompanying drawings. Wherever possible, the same reference numbers will be used throughout the drawings to refer to the same or like parts.

As described above, existing lighting devices are static, and designed to be held or fixed to a person, vehicle, or object. As a result, military and law enforcement officers are left with relatively constrained options for illuminating potentially threatening areas. Accordingly, the present disclosure is directed to various embodiments of a deployable, multi-sided illumination device that is configured to be thrown, projected, rolled, and/or autonomously guided into a darkened area. Specifically, according to certain embodiments, the deployable, multi-sided illumination devices may be any multi-sided shape, from cube-like, to spherical, and having any number of sides, such that it may be relatively mobile and throwable, but in some cases may come to a rest on one of its sides or surfaces. The deployable, multi-sided illumination device may also comprise a plurality of LEDs or other lighting devices configured to illuminate a plurality of directions extending away from the multi-sided illumination device. Moreover, the deployable, multi-sided illumination device may comprise a trigger, detonator, and/or switch accompanied by suitable logic circuitry to enable the device to have delayed or timed operation, thereby providing its users with more safe, effective, and customized use.

Figure 1:
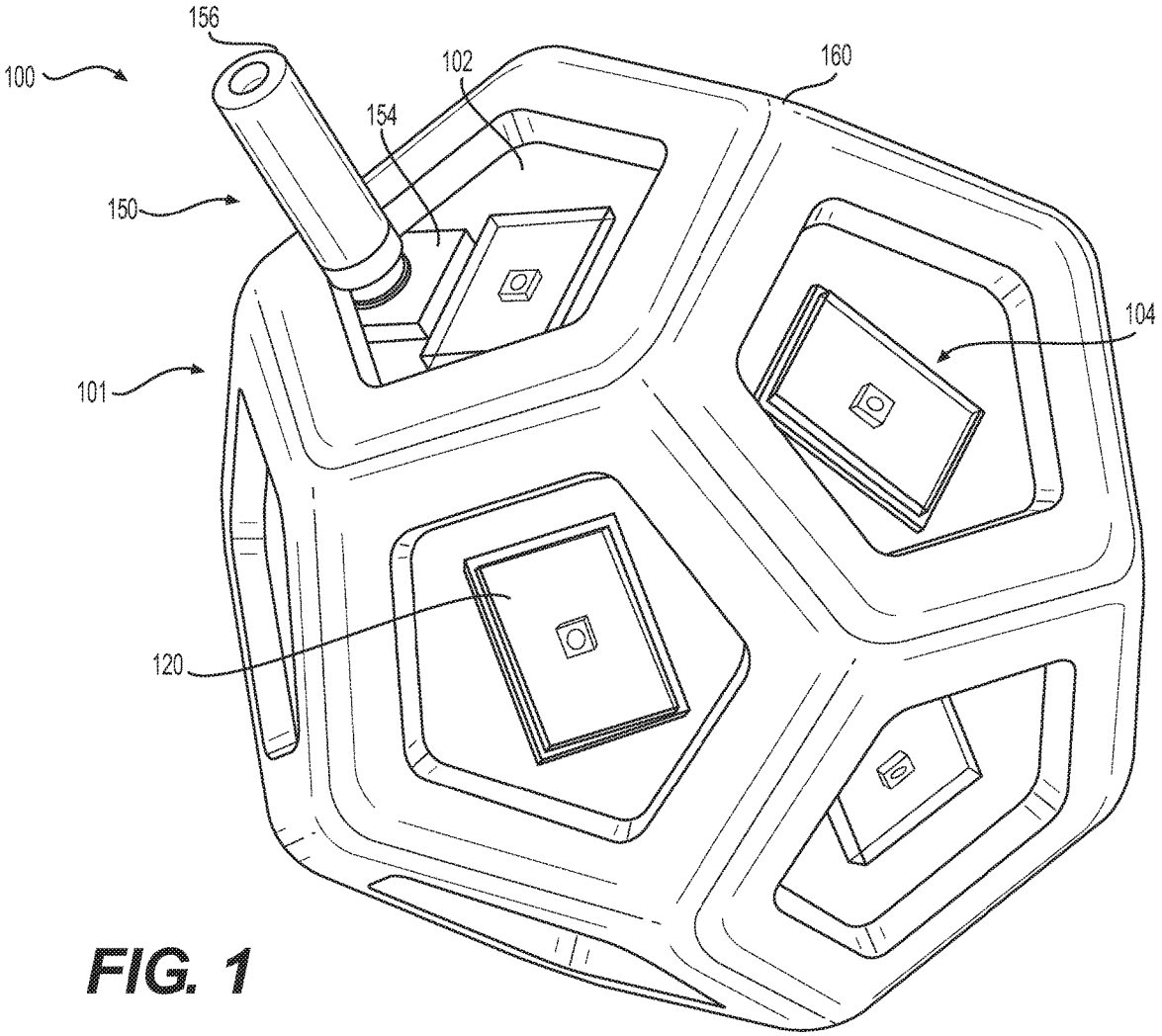
FIG. 1 is a perspective view of an illumination device according to an example of the present disclosure.
Figure 2:
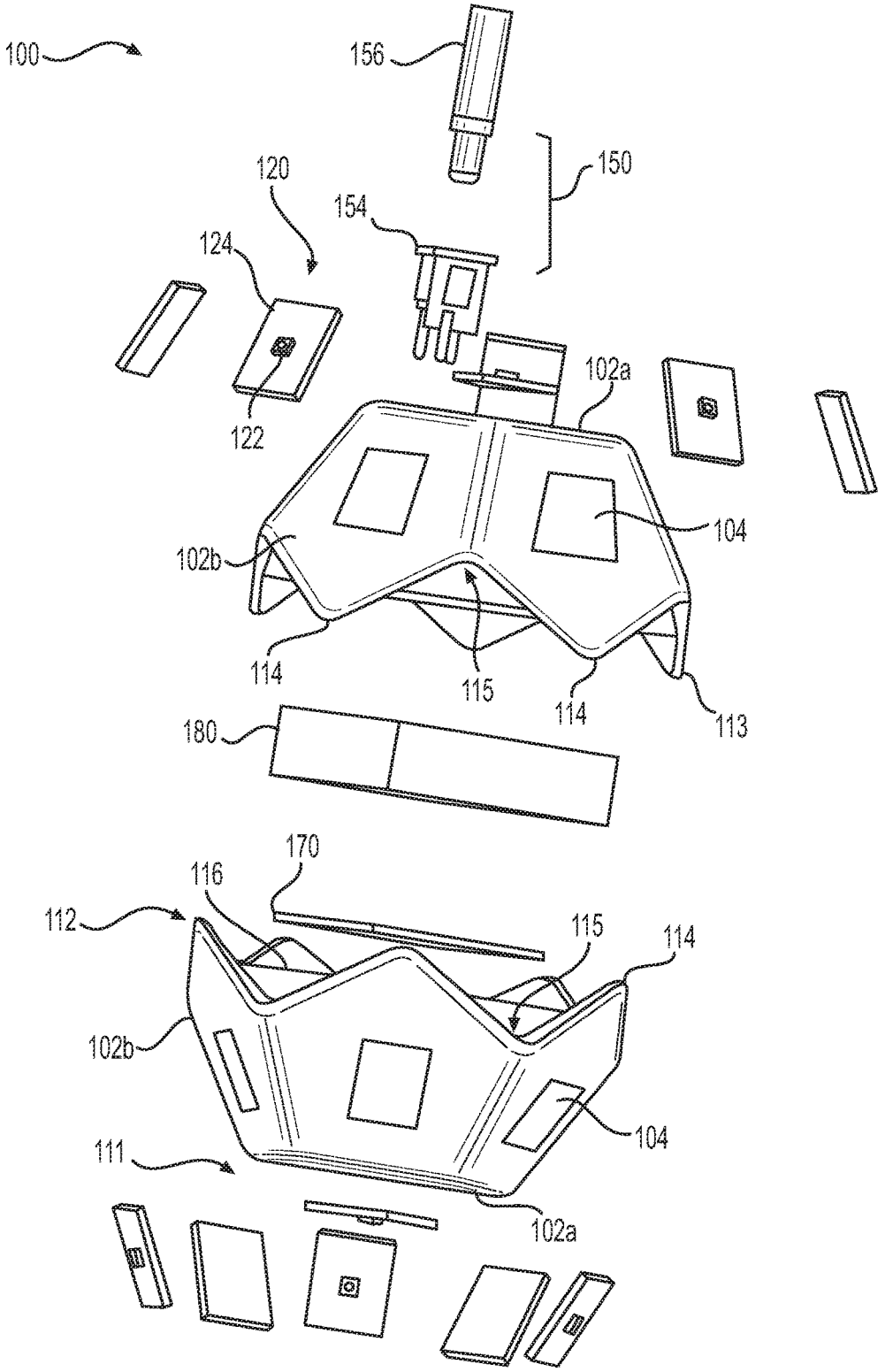
FIG. 2 is an exploded view of the illumination device of FIG. 1.

An exemplary embodiment of such a deployable, multi-sided illumination device 100 is shown in FIGS. 1 and 2. Illumination device 100 may include a body 101 having one or more sides 102 that together form an exterior surface of illumination device 100. In the example shown, illumination device 100 has twelve sides 102, and is configured as a regular dodecahedron, although other suitable shapes are contemplated as set forth in further detail below. Illumination device 100 may include a plurality of illumination modules 120, an activation mechanism 150, a cover 160, a printed circuit board (PCB) 170 (shown only in FIG. 2), and a power source 180 (shown in FIGS. 2 and 4).

Sides 102 may be flat to enable the illumination device 102 to come to rest after being deployed by a user (e.g., remain in a relatively static or fixed position), and emit light approximately equally in all directions (e.g., 360° illumination). The illumination device 100 may be formed using any number of sides having a flat outer surface (e.g., two or more sides with flat outer surfaces) and any number of illuminating modules 120 (e.g., one or more). One or more sides 102 may be shaped as regular pentagonal faces (e.g., each being a pentagon having five interior angles of 108°), although other suitable shapes are also contemplated.

In one embodiment, each side 102 may include a window 104, which may be formed of a clear and/or transparent material (e.g., acrylic, polycarbonate (e.g., LEXAN®), or the like), to allow for light emitted from illumination module 120 to pass through a respective side 102. The emitted light may be detected by an observer or detection device positioned externally of illumination device 100. In one example, each side 102 of illumination device may include a window 104. However, it is contemplated that one or more sides 102 may not include a window and may be entirely opaque. For example, one of the sides 102 may be an activation surface having various switches, indicators, and/or other components usable by an operator of illumination device. It is also contemplated that a side 102 may include both a window 104, and one or more other components disposed on a remaining portion of the same side 102.

In another example, an entirety or a substantial entirety of each side 102 may be transparent. In this example, a substantial entirety of body 101 may be formed from a high impact thermal plastic that is optically transparent over a wavelength range used for the particular illumination device 100. Suitable materials for body 101 include, but are not limited to, acrylic, polycarbonate, among others. Window 104 may be recessed within an interior surface 108 (shown in FIG. 3) of a side 102. In yet another example, some portions of body 101 may be formed of a non-transparent or semi-transparent material, while windows 104 are formed of a different, transparent material. For example, except for windows 104, body 101 may be formed of a metal (e.g., aluminum), metal alloy, plastic (e.g., polypropylene, PVDF, PVC, PTFE, CPVC, HDPE), or other suitable material. In such examples, body 101 may be formed in a first process (e.g., molding) leaving openings for windows 104, which may be installed after the first process is complete.

Body 101 may alternatively be formed with a spherical shape, an oblong shape, or any other curvilinear shape that does not include a flat surface. In these examples, the illumination device may be deployed without the need to come to a resting position, or could implement additional design elements that enhance the ability of illumination device to come to rest and remain in a fixed position. For example, additional features may include but are not limited to deployable legs, bumpers or stops; internal or external counter weights, external surfaces with adhesive properties, magnetic and/or ferromagnetic surfaces, etc. For example, an internal weight could be added to a spherical shape, and may be coupled to one internal surface such that when illumination device 100 is thrown, the force of gravity may cause the weighted surface to face downward. In another example, an unsecured or "floating" counterweight may be used within a circular or spherical illumination device 100 such that, after being thrown, the momentum and/or motion of the rolling illumination device 100 may slow the movement of the weight, allowing the weight to settle and stop the illumination device 100 until another outside force is applied to the illumination device 100. An internal or external weight may also be added to any other shape in order to attain the same or similar results using gravity. In another example, deployable legs may be coupled to one or more of sides 102, any may be movable between a compressed configuration and a deployed configuration. Initially, the deployable legs may be in the compressed configuration, and after some trigger, may transition into a deployed configuration, allowing an illumination device 100 to roll for a certain amount of time before the deployed legs limit further movement and urge the illumination device 100 to come to rest. In some examples, the deployable legs may not deploy until activation mechanism 150 is activated by a user. In some examples, the deployable legs may deploy after a delayed period of time has elapsed since activation of the activation mechanism 150. The delayed period of time may be the same period of delay used to activate illumination sources 122, or may be a shorter or longer delay.

Body 101 may be formed as an integral structure, and may be formed by joining multiple portions together. In one example, body 101 is formed from two body portions 110 (which may be referred to, e.g., as "halves" or "clamshells") which, when assembled, enclose some or most of the circuitry/componentry of illumination device 100. The two body portions 110 may be substantial mirror images of one another, fitting together and forming a sealed or nearly sealed interface providing strength to illumination device 100. The two body portions 110 may be mechanically joined at one or more mating interfaces by various friction mechanisms, such as snapping and adhesives, for example. Each body portion 110 may be formed from the same materials mentioned above with respect to body 101.

Figure 3:
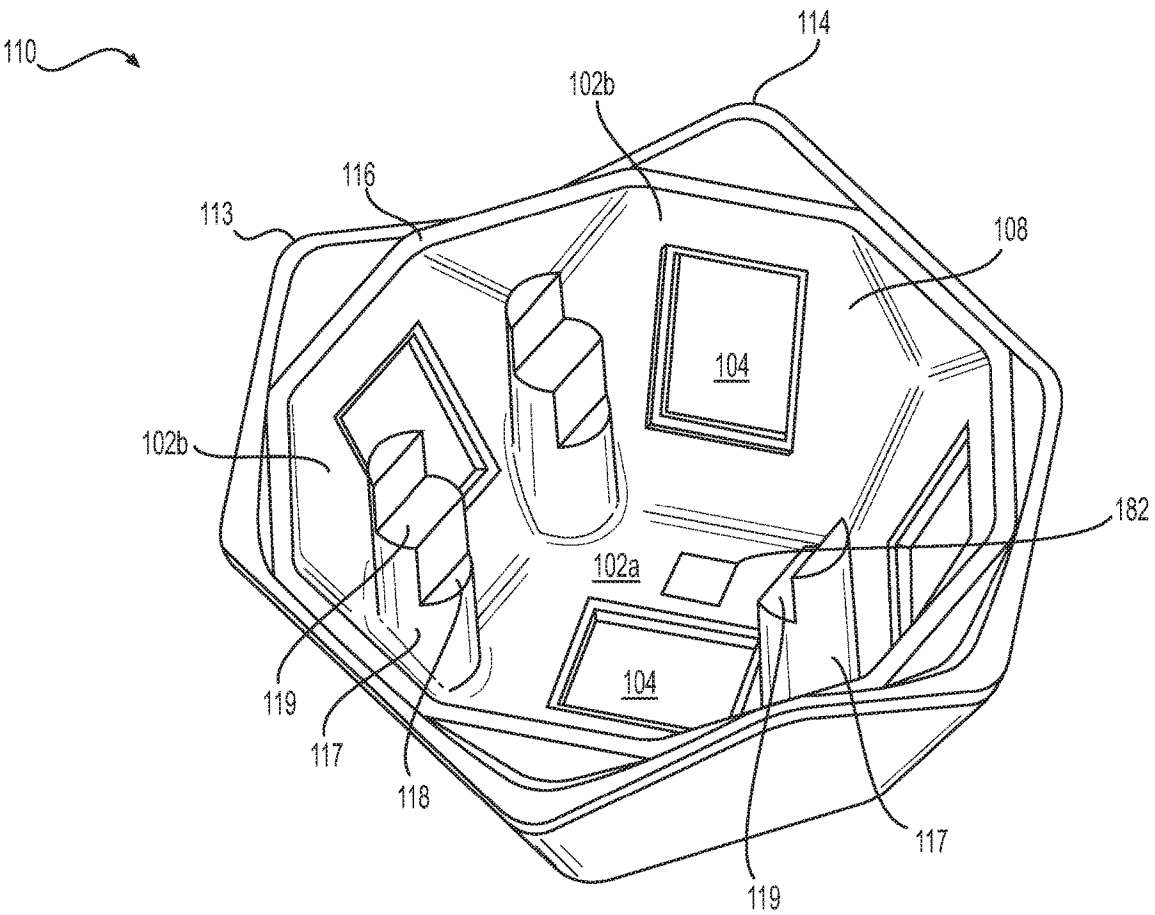
FIG. 3 is a perspective view of a body portion of the illumination device of FIG. 1.

Referring to FIGS. 2 and 3, body portion 110 may extend from a first end 111 toward a second end 112, and may include a first side 102*a* at first end 111 from which a plurality of second sides 102*b* extend both toward the second and in a radially outward direction. Each second side 102*b* may extend toward the second end 112 from a periphery of first side 102*a*. When illumination device 100 is unassembled, second end 112 of body portion 110 may be at least partially defined by an exposed first end surface 113 that is formed by the longitudinal ends of second sides 102*b*. The first end surface 113 may curve and/or undulate between one or more peaks 114 and valleys 115, and thus may lie in multiple planes. The peaks 114 may be disposed further away from first end 111 than the valleys 115. In the example shown, first end surface 113 may include five peaks 114 that alternate with five valleys 115. Each peak 114 may be the portion of each second side 102*b* disposed furthest from first end 111. Each valley 115 may be formed at an intersection of adjacent second sides 102*b*.

Body portion 110 may also include a second end surface 116 that is positioned radially inward of first end surface 113, and that may lie in a single plane. Second end surface 116 may face the same direction as first end surface 113. In the example shown in FIGS. 2 and 3, second end surface 116 may have nine sides. That is, second end surface 116 may form the outline of a nonagon, although other suitable shapes are also contemplated. Second end surface 116 may extend further away from first end 111 than valleys 115 of first end surface 113, but may be disposed closer to first end 111 than peaks 114.

Two body portions 110 may be coupled to one another to form body 101 of illumination device 100. The first end surface 113 of a first body portion 110 may be positioned adjacent to a corresponding first end surface 113 of a second body portion 110 such that the respective first end surfaces 113 of the first and second body portions 110 are flush with one another when illumination device 100 is in an assembled configuration shown in FIG. 1. Each valley 115 of first body portion 110 may receive a peak 114 of the second body portion 110, and each peak 114 of the first body portion 110 may be received by a valley 115 of the second body portion 110. The second end surface 116 of first body portion 110 may be positioned adjacent to a corresponding second end surface 116 of the second body portion 110 such that the respective second end surfaces 116 of the first and second body portions 110 are flush with one another when illumination device 100 is in the assembled configuration.

First end surface 113 and second end surface 116 may include one or more mating features configured to facilitate the coupling of body portions 110. Exemplary mating features include snaps, hooks, flanges, recesses, pins, or other suitable mating features. First end surfaces 113 and/or second end surfaces 116 may also be coated with adhesive to facilitate the coupling of body portions 110 to form body 101. When the two body portions 110 shown in FIGS. 2 and 3 are joined to one another, they may form body 101 (e.g., a dodecahedron) as shown in FIG. 1.

Referring to FIG. 3, body portion 110 may include one or more posts 117 that extend from first end 111 toward second end 112. Posts 117 may be disposed radially inward of second sides 102*b* so as to be enclosed by outer portions of body 101 when illumination device 100 is fully assembled. Each post 117 may include a first step 118 and a second step 119. Steps 118 and 119 may be positioned in different planes. As shown in FIG. 3, body portion 110 may include a plurality of posts 117 that may be positioned on opposing sides of body portion 110. As shown in FIG. 3, at least one pair of posts 117 may be positioned such that steps 118 and 119 of the pair of posts 117 face in opposite directions to form receiving areas for various components, such as, e.g., PCB 170 and power source 180. The first steps 118 of each the posts 117 may lie in a first plane and may be configured to receive, for example, PCB 170. The second steps of each of the posts 117 may lie in a second plane that is different from the first plane to form a receiving area for power source 180. First steps 118 disposed on opposite side of body portion 110 may be spaced apart from one another by a first distance. Second steps 119 disposed on opposite sides of body portion 110 may be spaced apart from one another by a second distance that is different from the first distance. The differential spacing may create staggered receiving areas for PCB 170 and power source 180, which may have different dimensions. In the example shown in FIG. 2, PCB 170 may be sized smaller than power source 180. Accordingly, first steps 118 may be disposed closer to first end 111 of body portion 110 than second steps 119, and the first distance separating first steps 118 may be smaller than the second distance separating second steps 119.

At least one side 102 of body 101 may include an opening 182 (shown only in FIG. 3) configured to receive activation mechanism 150. The opening 182 may be disposed adjacent to a window 104 on a given side 102. While shown in FIG. 3 as disposed on a first side 102*a*, it is also contemplated that the opening 182 may be disposed on a second side 102*b*.

Referring back to FIG. 1, cover 160 may be disposed around the outer surface of body 101. Cover 160 may have a similar shape as body 101 in order to fit securely around the body 101. For example, in FIG. 1, body 101 is a dodecahedron and cover 160 is also formed as a dodecahedron having twelve sides 162. However, cover 160 may also take other shapes depending on the shape of body 101, such as, e.g., a sphere when body 101 is shaped as a sphere. Cover 160 may have the same number of sides as the body 101. Cover 160 may be positioned onto the outer surface of illumination device 100 by a molding process to ensure the cover 160 protects the necessary external areas without limiting the illumination of the illuminated areas in a one-piece design that can be replaced if damaged.

In the example of FIG. 1, each side 162 may be positioned over a side 102 of body 101, and may define an opening 164. The opening 164 in each side 162 may allow light from a respective illumination module 120 to be seen by an observer positioned externally of illumination device 100. Cover 160 may be positioned over the edges of body 101 and may absorb impact forces when illumination device 100 is deployed by a user, and may reduce the amount of noise that illumination device 100 produces on impact. Cover 160 may be formed from a resilient material, such as, e.g., silicon, rubber, or a rubber-like material, such as, e.g., natural or synthetic rubbers. Cover 160 may have any suitable thickness. In one example, cover 160 may have a thickness of approximately 2 mm, although other thicknesses are also contemplated.

Illumination modules 120 may be operatively coupled to one or more of the sides 102 of body 101. In some examples, illumination module 120 may include an illumination source 122 positioned by snapping, adhesion, or other suitable mechanism, onto a substrate 124 such as, e.g., a printed circuit board (PCB). In one example, substrate 124 may be a FR4 printed circuit board. The illumination module 120 may be coupled to interior surface 108 of side 102 by any suitable mechanism, such as an adhesive or by snap-fit. Illumination source 122 may be an LED having a lamp lifetime of over 10,000 hours and a color rendering index of greater than 80.

Illumination source 120 may be configured to deliver light in one or both of the visible (photopic) and non-visible (non-photopic) portions of the light spectrum. Thus, illumination source 120 may be configured to emit visible light detectable by human eyes. In these photopic applications, an observer may utilize the light emitted from illumination source 122 to discern certain features in a field of view using natural vision, and in some cases, only natural vision (e.g., without the aid of detection devices). The visible light may be single wavelength or combinations of visible wavelengths from about 400-700 nm, which may correspond to normal mammalian vision. This light may include all possible colors (red, green, blue, cyan magenta, yellow, etc.) and all possible variations of white light (2700K, 3000K, 4000K, 6500K, etc.) that a standard human, canine, or other mammalian observer might be able to utilize while performing a task or while engaging in a decision-making process.

Illumination source 122 may also be configured to emit a single wavelength or combinations of visible wavelengths outside of the visible range of 400-700 nm, for example, corresponding to wavelengths outsides of normal mammalian vision. This includes ultraviolet radiation (e.g., having a wavelength less that about 400 nm) and infrared radiation (e.g., wavelengths greater than about 700 nm). These wavelengths, while not visible to a standard human, canine or other mammalian observer, may be used in combination with detection devices for certain applications. The ultraviolet light provided by illumination source 122 may be the same or similar ultraviolet light used in auto and welding applications to find fluid leaks, cracks, and/or abnormalities. Other sources of light, including blue lights, are also contemplated for use in illumination device 100.

Illumination source 122 may include fluorophores (naturally occurring and/or artificially added) to enable the detection of otherwise undetectable substances or features such as, e.g., biological matter, bodily fluids, chemical residues disposed in the targeted area. In these cases, an outside known media may be added to a surface to detect the presence of media unseen by visible light in normal instances (e.g., in forensic applications). When illumination source 122 is configured to emit infrared light, light amplification or conversion devices (including night vision goggles, photon doublers, or the like) may be used to detect the emitted infrared light. One advantage of using light from the non-visible spectrum is to conceal the tactical forces (e.g., police, military). Infrared light may allow for the detection of various levels of detail (e.g., watermarks or other markers) not normally detectable in only visible spectrum.

In some examples, a given illumination device 100 may be configured to deliver one or more different types of light from the visible and non-visible spectra.

Ultraviolet light may be used in illumination devices used to treat Seasonal Affect Disorder or for alternative light sourcing for crime scene processing. Flashing bulbs of, e.g., red, blue, or another color may be used for deployment on road surfaces during traffic accidents. Yellow illumination may be used in construction areas, and other varying bulb colors may be used for aesthetic enjoyment surrounding sporting events or other festive occasions.

Activation mechanism 150 may include a port 154 and an activation element 156 insertable into the port 154. The port 154 may be a charging port disposed through one side 102 of body 101. Port 154 may be configured to provide simple power cord charging of power source 180 via a standard charger port (e.g., 2-pin DC Jack, USB micro port, or the like). In some examples, charging of power source 180 may also be performed via inductive coupling (not requiring port 154 for charging purposes), an integrated solar panel, or other standard charging methods.

When port 154 is not used for charging, an activation element 156 may be inserted into the port 154. The presence of activation element 156 within port 154 may cause the illumination device 100 to remain in a first, inactive "off" state, and the removal of activation element 156 may cause the illumination device 100 to transition to a second, operating "on" state, as set forth in further detail below. Activation element 156 may have any suitable shape and, in one example, may be configured as a pin. The exposed portion of activation element 156 may be soft and/or resilient. For example, the exposed portion of activation element 156 that extends outward from port 154 may be formed of a foam or like material, such that activation element 156 may be removed from port 154 by biting the activation element 156 and pulling on the illumination device 100, without damaging the teeth of a user biting onto activation element 156.

Port 154, activation element 156, and/or any other portion of illumination device 100 may include safety features configured to help prevent the inadvertent removal of activation element 156 from port 154, thereby helping to prevent the inadvertent transition of the illumination device 100 from the standby "off" state to the operating "on" state. Any suitable safety features are contemplated including, for example, safety pins, latches, hooks, or the like. The safety feature may be set to be disengaged by the user before the removal of activation element 156 from port 154. It is also contemplated that in some examples, port 154 may itself be removed from body 101 to transition illumination device 100 from the standby "off" state to the operating "on" state.

Power source 180 may be any suitable power source configured to power the electrical components of illumination device 100, including, but not limited to, the illumination sources 122. In one example, power source 180 may be a rechargeable lithium ion battery that may be charged by standard electrical power supplies via port 154. Power source 180 may also be a non-rechargeable battery (e.g., alkaline, lithium, or the like), a super capacitor, a fuel cell, or another chemical generator. The power source 180 may be charged by other suitable techniques, including by solar power generators, thermal power generators, and mechanical hand generators.

The illumination modules 120 may be mounted to windows 104 in a manner that allows the light to emanate from within body 101. Once illumination modules 120 are secured, power source 180, PCB 170, and activation mechanism 150 may also be positioned within or onto body 101. Once these components are put into place, a substantial remainder of the volume of body 101 may be filled with a potting material. The potting material may be any suitable solid or gelatinous material configured to provide illumination device 100 with resistance to shock or vibrations during deployment, and to add mass to the illumination device 100 for improved deployment. It is contemplated that the potting material may act as a heat sink for the electronic components and illumination sources of illumination device 101. A small hole (not shown) on one side of the illumination device 100 may be used as an inlet for the potting material, and a small hole (not shown) may also be created for the outlet of air from the illumination device 100, similar to a normal molding operation. In this example, these small holes may be covered by cover 160 after the illumination device 100 has been filled with potting material.

The assembled illumination device 100 may have a diameter of approximately 50 to 150 mm, such as, e.g., 94 mm; a width of 50 to 150 mm, such as, e.g., 78 mm; and a mass of 150 to 300 grams, such as, e.g., 235 grams; although other suitable dimensions and weights are also contemplated. Illumination device 100 may be operable in temperature ranges from 0° C. to 45° C., in relative humidity between 0 to 95%, and may have a yield strength of 3000 psi. It should be noted that these values are only exemplary, and illumination device 100 may be configured to operate outside of these ranges in some circumstances.

Figure 4:
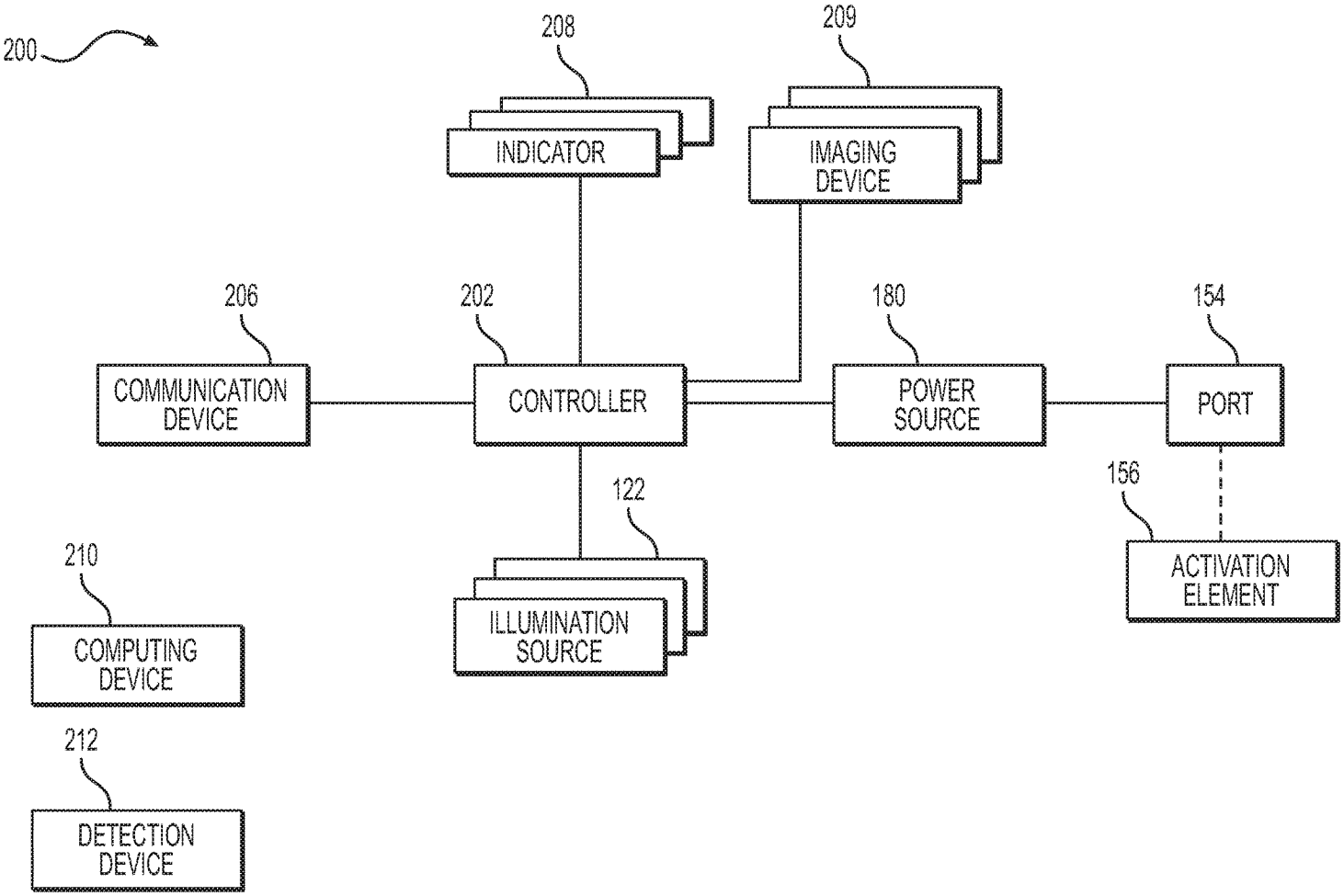
FIG. 4 is a schematic view of an electronics system of the illumination device of FIG. 1.

Illumination device 100 may include an electronics system 200 depicted schematically in FIG. 4. System 200 may include a controller 202, illumination sources 122, port 154, activation element 156, power source 180, a communication device 206, one or more indicators 208, and one or more imaging devices 209. System 200 may also include a mobile device 210 and a detection device 212.

Controller 202 may be disposed on PCB 170 described above with reference to FIG. 2. The controller 202 may include may include a processor that is generally configured to accept information from the system and system components, and process the information according to various algorithms to produce control signals for controlling illumination sources 122 and indicators 208. The processor may accept information from the system and system components, including from port 154, activation element 156, communication device 206, and mobile device 210, and process the information according to various algorithms. The processor may be a digital IC processor, analog processor, or any other suitable logic or control system that carries out the control algorithms.

The communication device 206 may include any suitable form of electronic communication device, including, for example, a transmitter/receiver configured for BLUETOOTH, BTLE, Wi-Fi, or other communication protocols. It is also contemplated that in lieu of or in addition to communication device 206, which may be a wireless communication device, port 154 may be used as a port for wired communication protocols, such as, e.g., USB.

Indicators 208 may be coupled to controller 202, and may be any suitable indicators configured to convey information regarding a status of illumination device 100. For example, indicators 208 may include one or more visual indicators (e.g., LEDs or similar devices) of the same or different colors. Indicator 208 may also include a vibration element configured to vibrate and/or pulsate. Indicator 208 may also include other types of indicators, such as, e.g., display screens and audio output devices.

Imaging devices 209 may be operatively coupled to controller 202, and may be any suitable imaging devices configured to capture image and/or video data. The imaging devices 209 may be mounted to sides 102 of body 101 in a substantially similar manner as illumination sources 122. In some examples, imaging devices 209 may be located on each side of body 101, although in other examples, imaging devices may be selectively placed on fewer than all sides 102 of body 101. Imaging devices 209 may be configured to capture image and/or video data through the windows 104 of body 101, and send that captured data to controller 202, where it may be transferred to, e.g., computing devices 210 via communication device 206. Once deployed, users of illumination device 100 (e.g., law enforcement or military) may utilize imaging devices 209 to view real-time or delayed image and/or video feeds at the deployment sites.

Computing device 210 may be, for example, a personal computer, personal digital assistant (PDA), mobile telephone, or another suitable device configured to send instructions to controller 202 via, e.g., communication device 206 or port 154.

Detection device 212 may be configured to aid an observer in detecting light in the non-visible spectra, for example, infrared or ultraviolet light, when illumination device is configured to emit light in those particular wavelengths. The detection device 212 may be goggles or other eye-ware configured to detect light in the non-visible spectrum.

Controller 202 may control operation of illumination device 100 between a plurality of different operating states. For example, controller 202 may operate illumination device 100 in an on state, and off state, and a charging state. In the on state, one or more of illumination sources 122 may be turned on so as to emit light, whereas in the off state, illumination sources 122 may be turned off. During the charging state, power source 180 may be coupled to a charging device via, e.g., port 154 or by inductive charging methods. It is contemplated that during the charging state, illumination sources 122 may be turned off, although in some examples, illumination sources 122 may be turned on in the charging state.

Controller 202 may be configured to maintain illumination device 100 in the off state while activation element 156 is disposed within port 154. That is, controller 202 may be configured to sense the presence of activation element 156 within port 154. Controller 202 may achieve this in any suitable manner. In one example, activation element 156 may activate a switch while docked in port 154. The switch may send a signal to controller 202 indicating that activation element 156 is disposed within the port 154. When the activation element 156 is removed from port 154, the switch may send a signal to the controller 202 indicating that the activation element 154 has been removed. In another example, the port 154 or another portion of illumination device 100 may include a reader configured to detect a unique identifier disposed on activation element 154. For example, a short range RFID reader may be used to determine whether activation element 156 is disposed within port 154. As alluded to above, charging port 154 may itself be removable from the body 101, and controller 202 may be configured to sense that charging port 154 has been removed from the body to transition illumination device 100 from the standby "off" state to the operating "on" state.

Once the activation element 156 is removed by a user from port 154, controller 202 may be configured to transition the illumination device 100 from the off state to the on state after a predetermined delay period. That is, after detecting that activation element 156 has been removed from the port 154, the controller 202 may maintain illumination device 100 (and illumination sources 122) in the off state until the predetermined delay period has elapsed. The predetermined delay period can be any suitable period ranging from, e.g., 0.1 to 10 seconds. In other examples, the predetermined delay period can even be minutes, hours, or days. In one example, the predetermined delay period may be at least three seconds. In other examples, the predetermined delay period may be at least five or six seconds. The predetermined delay period may be set to a default that can be changed by a user via, e.g., a mobile device 210, or by another suitable user input device coupled to controller 202.

Illumination device 100 may be transitioned from the on state to the off state when an activation element 156 is inserted back into port 154, for example, after the illumination device 100 has been deployed in the field. The same activation element 156 may be inserted into the port 154 to transition illumination device 100 into the off state. However, when illumination device 100 is used in certain situations, such as, e.g., police, tactical, and/or military applications, it is possible or even likely that the activation element 156 that was pulled from port 154 to activate the illumination device 100 may be discarded or lost in the field. Thus, a new activation element 156 may be used to deactivate the illumination device 100. The new activation element 156 may have the same geometry, identification, and/or authentication features as the original activation element 156 to prevent an unauthorized party from transitioning the illumination device 100 from the on state to the off state. In one embodiment, the activation element 156 may be a regularly occurring object, such as a AA battery, a lighter, a magnetic strip card, an electrically insulating plastic strip or toothpick, a USB "thumb drive," a keyring, etc. such that a user may easily replace the activation element 156 when it is lost.

Other mechanisms are also contemplated for use in transitioning illumination device 100 from the off state to the on state, such as, e.g., standard switches, proximity sensors, magnetic reed switches, inductive coupling, and wireless remote methods including both optical (infrared, etc.) and RF techniques (Bluetooth, Zigbee, proprietary, or the like). For example, illumination device 100 may be armed in response to a wireless instruction sent from computing device 210. The wireless instruction may be sent before, during, or after deployment of the illumination device 100 in the field. In some examples, multiple illumination devices may be deployed and controlled by a single computing device 210. In such examples, computing device 210 may send instructions to various illumination devices 100 to transition to the on state individually or simultaneously. It is further contemplated that computing device 210 may be able to act as a secondary or fail-safe instruction should one or more portions of illumination device 100 experience a fault during use in the field. For example, if controller 202 failed to sense that activation element 156 was removed or if for some other reason, the illumination device 100 did not transition to the on state once activation element 156 was removed, computing device 210 may be used to send a signal and instruction to controller 202 to transition illumination device 100 to the operating ("on") state.

Controller 202 may be configured to provide an indication to the user that the unit is armed (or otherwise in a transition between the off state and the on state) via one or more indicators 208. As set forth above, the indicators used to indicate an armed state of the illumination device may include lights (e.g., a blinking or non-blinking LED indicator), audio output devices (e.g., a beeper or speaker), vibration units, or any other suitable indicator. In one example, indicator 208 may be a vibration unit configured to produce a relatively inaudible vibration once activation element 156 is removed from port 154. The indication communicating an armed state of the device may be discontinued once the illumination device 100 converts to the on state and begins emitting light.

Controller 202 may also be configured to maintain illumination device 100 in a charging state when, for example, power source 180 is being charged through port 154 or by inductive charging methods. Controller 202 may be configured to provide a positive indication of the charge status of the power source 180 by, e.g., any of the sensory indicators described above. In one example, the indication may be communicated by an LED array near the charge port, which may be active only when the illumination device 100 is being charged. In some examples, indication of the charge status may use the same LED used to indicate that the illumination device is armed. In other examples, differently colored LEDs may be used to indicate different statuses. For example, an LED emitting a first color (e.g., amber) may indicate that the power source 180 is currently charging, while an LED emitting a second color different from the first color (e.g., green) may be used to indicate that the power source 180 is full. Power source 180 may be configured to maintain illumination device in the on state for five or more hours, and may be fully charged for over 300 cycles, until, for example, the power source 180 can maintain only 80% of its original charge capacity. The power source 180 may be configured to charge fully in four hours, although other suitable charge times are also contemplated. In one example, power source 180 may have a capacity of 3000 mAh. Power source 180 may be charged by a charging device configured to receive 90-240 VAC, and output 5 VDC. Illumination device 100 may be configured for active current regulation.

After removal of a charging device from port 154, controller 202 may be configured to transition illumination device to an operating "on" state. In order to prevent inadvertent activations, controller 202 may be configured to delay transition of the illumination device 100 to an operating "on" state after being in a charging state for a predetermined delay period. The predetermined delay period may be any suitable period in this instance, including, for example, one minute, although other suitable times are also contemplated. In other examples, controller 202 may be configured to prevent illumination device 100 from transitioning to an operating "on" state from a charging state until an activation element 156 is docked within port 154. That is, illumination device 100 may not transition from a charging state to an on state until an activation element 156 is inserted into port 154. Thus, controller 202 may be configured to automatically transition from the charging state to the off state. In such examples, once illumination device 100 enters the charging state, it may only be transitioned to the on state after an activation element 156 in inserted and subsequently removed from port 154. Or, in those examples not using an activation element 156, illumination device 100 may transition to the on state only after the charging state when another suitable activation protocol is performed.

The illumination device 100 may be prepared for use, and deployed in the field, without any additional accessories or equipment. However, it is also contemplated that any number of accessories may be used with the illumination device 100. For example, the illumination device 100 may be transported by the use of a specialized cradle, holster, or other device that would allow the illumination device to be transported by a human, canine, or mammalian entity. These holsters or cradles may be configured to provide a charging function for power source 180. These holsters or cradles may be configured to provide automatic on/off or arming/disarming functions. For example, instead of an activation element 156, when controller 202 senses that the illumination device has been removed from its dock or cradle, controller 202 may be configured to transition the illumination device from the off state to the on state after a predetermined delay period. The illumination device 100 may also be transported by the use of a specialized cradle, holster, or other device that allows the illumination device 100 (or group of illumination devices 100) to be transported in a secondary storage device such as, e.g., a hand bag, backpack, motorized vehicle, parachute, cargo launcher, or other suitable storage device.

In another example, illumination device 100 may include a speaker configured to project noise in a large decibel range, such as, e.g., siren noises or the like to provide a distraction that a tactical force could use to its advantage.

ALTERNATIVE USES AND APPLICABILITY

The illumination device 100 may be thrown, rolled, or otherwise deployed into unlit rooms, hallways, stairwells and otherwise unlit areas to provide light and a tactical advantage to tactical forces using the illumination device 100. The emitted light may be a high intensity white light in a Lambertian distribution, ensuring a consistent and uniform distribution of light in all directions no matter how the illumination device 100 lands. The dodecahedron construction may help ensure that a deployed illumination device 100 comes to rest with a minimum of ten lighted sides 102 operational.

The illumination device 100 may not be destroyed easily by conventional methods, and may prevent unauthorized deactivation by use of a keying mechanism, e.g., magnetic or digital keying mechanisms. Thus, the illumination device 100 may be virtually indestructible and may remain intact after being run over by an automobile, and may be completely waterproof (IP67). Once deployed, e.g., rolled, thrown, or placed into position, the illumination device 100 may remain operational for a period of time minimally consistent with hours of darkness and maintain a reliable and intense light. Illumination device 100 may be completely submergible and waterproof up to 1 meter, although additional levels of waterproofing are also contemplated. Illumination device 100 may be used by divers or for decorative lighting in a swimming pool.

The delay between removal of the activation element 156 and the transition from the off state to the on state may allow a user to tactically deploy the illumination device 100 in the dark, without giving ground to the user's own location. The illumination device 100 may activate only after being deployed once in the zone of required operation. This may provide an additional level of safety for police officers, tactical forces, military forces, or the like, by allowing those forces to visualize dangerous suspects or behaviors without giving away their location. Once an area has been cleared, the illumination device 100 can be retrieved and redeployed.

The illumination device 100 may be easily deployable over long distances, yet large enough to break through double pane glass if necessary. In one example, illumination device 100 may provide 400 lumens of light for five hours and may be fully rechargeable. The internal sealed power source may provide more than 300 full recharge cycles. The illumination device 100 may provide high output, exceptional reliability, and long lifetime.

Other illumination devices 100 may be used in home or commercial applications, such as, e.g., camp or outdoor lighting, mechanical lighting, pool lighting, construction lighting, and other concepts.

Any aspect set forth in any example may be used with any other example set forth herein. It will be apparent to those skilled in the art that various modifications and variations can be made in the disclosed systems and processes without departing from the scope of the disclosure. Other examples of the disclosure will be apparent to those skilled in the art from consideration of the specification and practice of the disclosure herein. It is intended that the specification and examples be considered as exemplary only. The following disclosure identifies some other examples.

We claim:

1. An illumination system, comprising:

a body having twelve sides, the body being formed by a first body portion including six sides of the twelve sides, and a second body portion including another six sides of the twelve sides, the first body portion and the second body portion being coupled to one another at a first interface positioned in a plurality of planes undulating radially about the body, wherein the first body portion comprises an end surface that undulates between peaks and valleys, and the second body portion comprises an end surface that undulates between peaks and valleys, the first interface is formed by the peaks and valleys of the first body portion and the peaks and valleys of the second body portion such that each peak of the first body portion is received by a valley of the second body portion, and each peak of the second body portion is received by a valley of the first body portion, and at least a portion of each of the twelve sides includes a transparent window and resilient material molded around an outer periphery of each transparent window;

a plurality of illumination sources, each of the plurality of illumination sources being configured to emit light through a respective transparent window;

a controller coupled to the plurality of illumination sources;

a communication assembly operatively coupled to the controller, wherein the controller is configured to activate the plurality of illumination sources in response to a wireless signal received by the communication assembly; and a wireless remote, physically separate from the body, wherein the wireless remote is configured to send the wireless signal to the communication assembly to activate the one or more illumination sources.

2. The illumination system of claim 1, wherein the wireless remote is configured to send a different wireless signal to the communication assembly to deactivate the one or more illumination sources.

3. An illumination system, comprising:

a multi-sided body, wherein the multi-sided body is formed by a first body portion and a second body portion, the first body portion and the second body portion are coupled to one another at a first interface, the first body portion comprises half of the sides of the multi-sided body and an end surface that undulates between peaks and valleys, and the second body portion comprises another half of the sides of the multi-sided body and an end surface that undulates between peaks and valleys;

resilient material molded around the body, the resilient material defining outer peripheries of a plurality of windows;

one or more illumination sources configured to emit light through a respective window of the plurality of windows;

a controller coupled to the one or more illumination sources; and a communication assembly operatively coupled to the controller, wherein the controller is configured to activate the one or more illumination sources in response to a wireless signal received by the communication assembly.

4. The illumination system of claim 3, further including a wireless remote, physically separate from the body, wherein the wireless remote is configured to send the wireless signal to the communication assembly to activate the one or more illumination sources.

5. The illumination system of claim 4, wherein the wireless remote is configured to send a different wireless signal to the communication assembly to deactivate the one or more illumination sources.

6. The illumination system of claim 3, wherein the resilient material is a one-piece cover.

7. An illumination system, comprising:

a multi-sided body having one or more transparent windows, and resilient material molded around and defining an outer periphery of each of the one or more transparent windows, wherein the multi-sided body is formed by a first body portion and a second body portion, the first body portion and the second body portion are coupled to one another at a first interface, the first body portion comprises half of the sides of the multi-sided body and an end surface that undulates between peaks and valleys, and the second body portion comprises another half of the sides of the multi-sided body and an end surface that undulates between peaks and valleys; and one or more illumination sources configured to emit light through a respective transparent window of the body.

8. The illumination system of claim 7, wherein the first interface is formed by the peaks and valleys of the first body portion and the peaks and valleys of the second body portion such that each peak of the first body portion is received by a valley of the second body portion, and each peak of the second body portion is received by a valley of the first body portion, the first interface being positioned in a plurality of planes.

9. The illumination system of claim 7, further including a second interface disposed radially inward of the first interface, and positioned in a single plane.

10. The illumination system of claim 7, wherein each side of the multi-sided body includes a transparent window recessed into an interior side of the multi-sided body.

11. The illumination system of claim 7, further including a controller coupled to the one or more illumination sources, and a communication assembly operatively coupled to the controller, wherein the controller is configured to activate the one or more illumination sources in response to a wireless signal received by the communication assembly.

12. The illumination system of claim 11, further including a wireless remote, physically separate from the multi-sided body, wherein the wireless remote is configured to send the wireless signal to the communication assembly to activate the one or more illumination sources.

13. The illumination system of claim 12, wherein the wireless remote is configured to send a different wireless signal to the communication assembly to deactivate the one or more illumination sources.

14. The illumination system of claim 7, wherein the resilient material includes a one-piece cover.

15. The illumination system of claim 7, wherein the resilient material includes rubber.

16. The illumination system of claim 7, wherein the multi-sided body includes twelve sides.

17. The illumination system of claim 16, wherein the one or more illumination sources includes twelve illumination sources, and wherein one of the twelve illumination sources is mounted to each of the twelve sides.

18. The illumination system of claim 7, further including a potting material disposed within an internal volume of the body.

* * * * *